US005707094A

United States Patent [19]

Gower

[11] Patent Number: 5,707,094

[45] Date of Patent: Jan. 13, 1998

[54] BATTERY LIFT APPARATUS FOR ELECTRIC VEHICLES

[75] Inventor: Lloyd R. Gower, Armada, Mich.

[73] Assignee: Chrysler Corporation, Auburn Hills, Mich.

[21] Appl. No.: 662,828

[22] Filed: Jun. 12, 1996

[51] Int. Cl.[6] ..... B66C 1/02

[52] U.S. Cl. ..... 294/65; 294/64.1; 414/627

[58] Field of Search ..... 294/64.1, 64.2, 294/64.3, 65; 414/627, 737, 752; 901/40

[56] References Cited

U.S. PATENT DOCUMENTS

| | | | |
|---|---|---|---|
| 2,390,242 | 12/1945 | Engler . | |
| 2,874,989 | 2/1959 | Reynolds . | |
| 3,347,327 | 10/1967 | Engelen et al. . | |
| 3,423,119 | 1/1969 | Stanley . | |
| 3,677,598 | 7/1972 | Becker . | |
| 3,734,325 | 5/1973 | Stone | 294/64.1 |
| 3,865,420 | 2/1975 | Warren | 294/64.1 |
| 3,933,388 | 1/1976 | Conboy . | |
| 3,970,341 | 7/1976 | Glanemann et al. . | |
| 4,453,755 | 6/1984 | Blatt et al. . | |
| 4,466,764 | 8/1984 | Hutter, III . | |
| 4,557,659 | 12/1985 | Scaglia . | |
| 4,828,306 | 5/1989 | Blatt . | |
| 4,925,225 | 5/1990 | Dost | 294/64.1 |
| 5,277,468 | 1/1994 | Blatt et al. . | |

*Primary Examiner*—Dean Kramer
*Attorney, Agent, or Firm*—Roland A. Fuller, III

[57] ABSTRACT

A battery lift apparatus, for use with an overhead air hoist, adapted to lift and load heavy vehicle batteries into a tray of an electric powered vehicle including a rectangular-shaped carrier beam of electrically insulative plastic material, formed with a plurality of manifold passageways which, in combination with a plurality of flexible lines, provide a distribution network for supplying pressurized system air to a plurality of suction assemblies mounted on the beam. First and second handles, secured adjacent opposite end faces of the beam, enable a pair of operators to readily position each battery on the tray. The first actuator handle is mounted by a bracket assembly supporting a valve block pair of valve unit actuators controlling up and down movement of the air hoist cable, and a pilot valve actuator is adapted for supplying vacuum releasing system air to each vacuum cup. The first handle bracket assembly, which allows rotational ergonomic adjustment of the first handle, supports the valve actuators for operation by a finger of the operator's hand gripping the first handle.

7 Claims, 3 Drawing Sheets

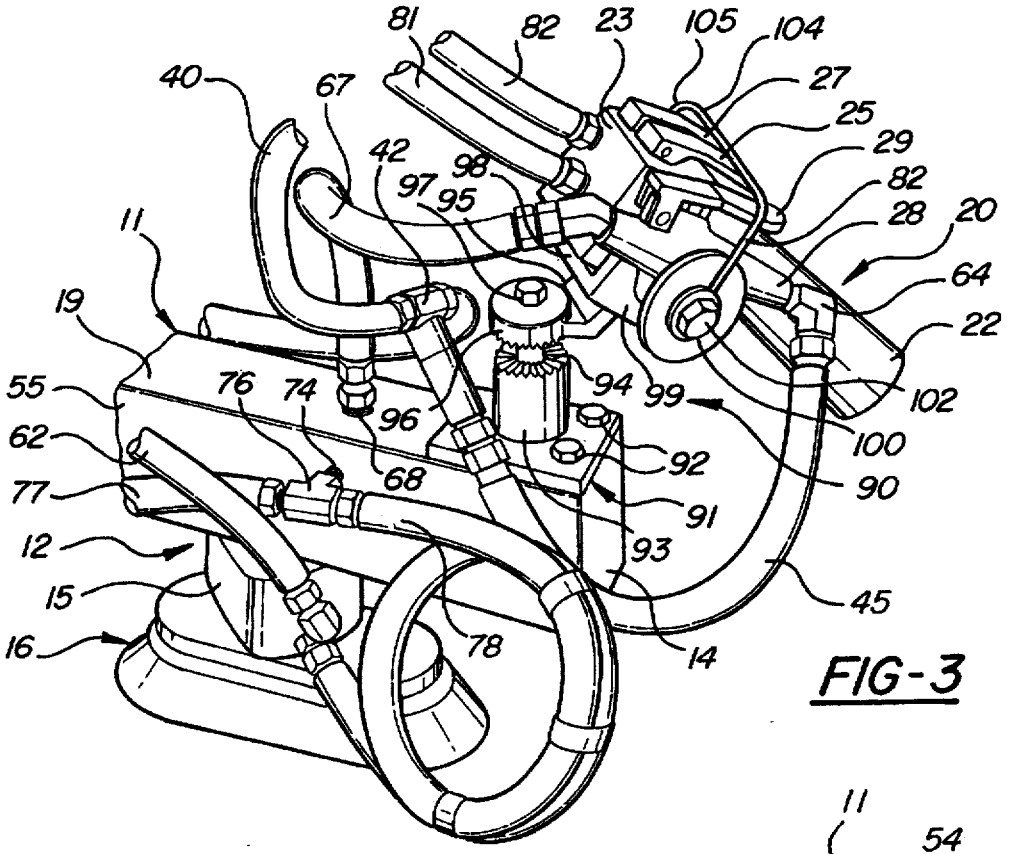
FIG-3
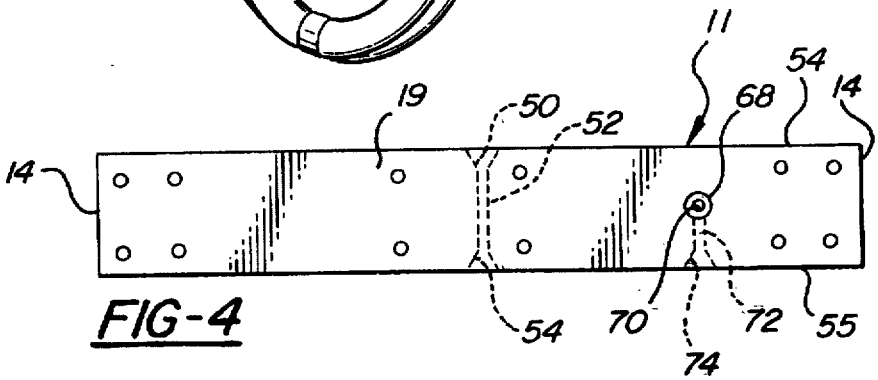
FIG-4
FIG-6
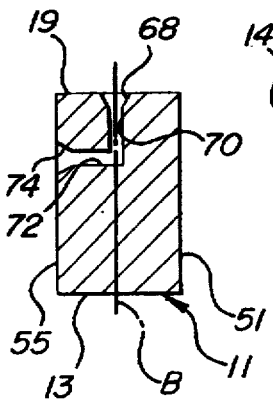
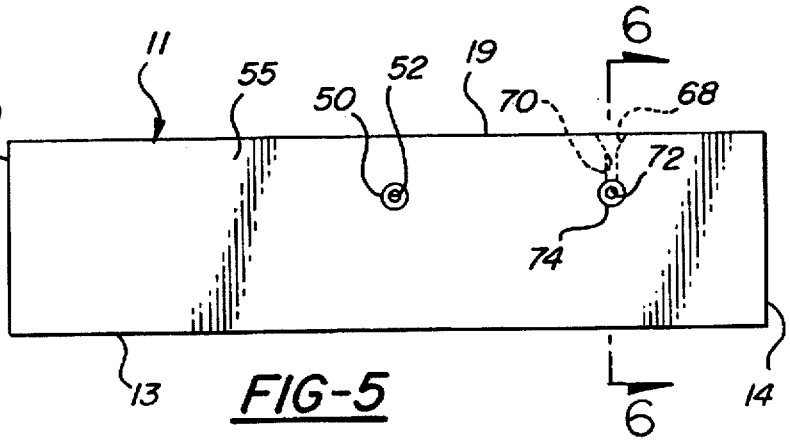
FIG-5

BATTERY LIFT APPARATUS FOR ELECTRIC VEHICLES

FIELD OF THE INVENTION

This invention relates generally to article handling devices and, more particularly, to a pneumatically-operated vehicle battery lift apparatus, in combination with an air hoist, for lifting, holding, and transporting batteries for electric powered vehicles.

BACKGROUND OF THE INVENTION

Various handling devices for lifting heavy batteries into or out of electric powered vehicles have been proposed. Known battery handling arrangements include a device for installing and removing an extremely heavy battery from an electric vehicle by means of a battery tray, removably attached to a vehicle chassis by a plurality of hydraulic cylinders, operative to load or unload the battery on the chassis.

It is known in the automotive industry that to provide a power supply for an electric vehicle, it is customary to use a plurality of batteries that are electrically series-connected to one another. For example, when a battery of 12 volts is used it is necessary to electrically series-connect on the order of twenty five batteries to produce the desired electric power. To install the connected batteries on the electric vehicle, it is the practice to first load, secure, and electrically wire the batteries in a tray, and thereafter install the loaded tray on the vehicle chassis. In an assembly line operation for producing electric vehicles, a need has arisen for an ergonomic battery carrier device, in combination with an overhead air hoist, which allows for lifting and transporting the batteries to a vehicle battery support tray for ready positioning juxtaposed a loaded battery.

SUMMARY OF THE INVENTION

A feature of the present invention is to provide a vehicle battery lift apparatus for use with an air hoist, including a carrier beam of electrically insulative structural plastic material supporting a plurality of suction assemblies thereon. The beam is formed with a plurality of manifold passageways which, in combination with a network of flexible air lines, provide a distribution network for supplying pressurized system air to a suction assembly vacuum generator vacuum cup for lifting a heavy vehicle battery.

Another feature of the present invention is to provide an air network that provides balanced system air to a plurality of vacuum holding cups, whereby the cups are operable to simultaneously release the battery.

A further feature of the present invention is a carrier beam that includes an actuator handle adjacent one end thereof, having bracket means supporting a pair of valve unit actuators operative for controlling the air hoist, and a pilot valve actuator, operative for supplying system air to each of the plurality of vacuum cups to release the vehicle battery.

It is yet another feature of the present invention to provide a vehicle battery lift apparatus wherein the valve actuators are in the form of three side-by-side lever actuators, thereby allowing each lever actuator to be depressed by a finger of the operator's hand whereby gripping the actuator handle while maneuvering the battery to a predetermined location in a battery tray is possible.

A still further feature of the present invention is to provide an actuator handle supported by a handle mounting assembly including a base fixed to the beam and a valve support arm. The base has an upstanding stem terminating in a mounting seat, while one end of the arm has a disc rotatably secured by releasably fastener means on the stem seat. Indexing means on the stem seat and an opposed face of the disc are adapted for selective interlocking, upon tightening the fastening means, enabling an operator to rotationally position the actuator handle to a desired ergonomic position.

The present invention also provides a battery lift apparatus wherein the insulative carrier beam includes a cable connection arrangement in the form of a metallic anchor plate, fixed to an upper face of the beam, having an upstanding lifting tongue positioned in a vertically disposed, longitudinal plane of symmetry of the beam. The tongue is sandwiched between a pair of strap members of electrically insulative fibre material, with each strap member one end pivoted by a through bolt to the lifting tongue and each strap free end joined by a through bolt adapted for engagement by a hook on the lower end of the air hoist cable.

A final feature of the invention is to provide a battery lift apparatus, in combination with an air hoist, wherein the actuator handle, together with a second handle adjacent the carrier beam opposite end, enable two operators to readily lift, transport, and position a heavy vehicle battery on a battery tray, in an ergonomic electrically insulative manner. The lifted battery is insulated at three levels, namely the rubber vacuum cups, the plastic carrier beam, and the pair of insulative straps connecting the beam lifting tongue to the air hoist cable.

These and other features and advantages of the invention will be more fully understood from the following detailed description of the invention taken together with the accompanying drawings.

BRIEF DESCRIPTION OF THE DRAWINGS

In the drawings:

FIG. 3 is an enlarged fragmentary perspective view of the air valve actuator handle portion of the apparatus of FIG. 2;

FIG. 4 is an enlarged detail top view of the insulative carrier beam of the apparatus of FIG. 1;

FIG. 5 is an enlarged detail side view of the beam of FIG. 4; and

FIG. 6 is a vertical cross sectional view taken on the line 6—6 of FIG. 5.

DETAILED DESCRIPTION OF THE INVENTION

Figure 1:
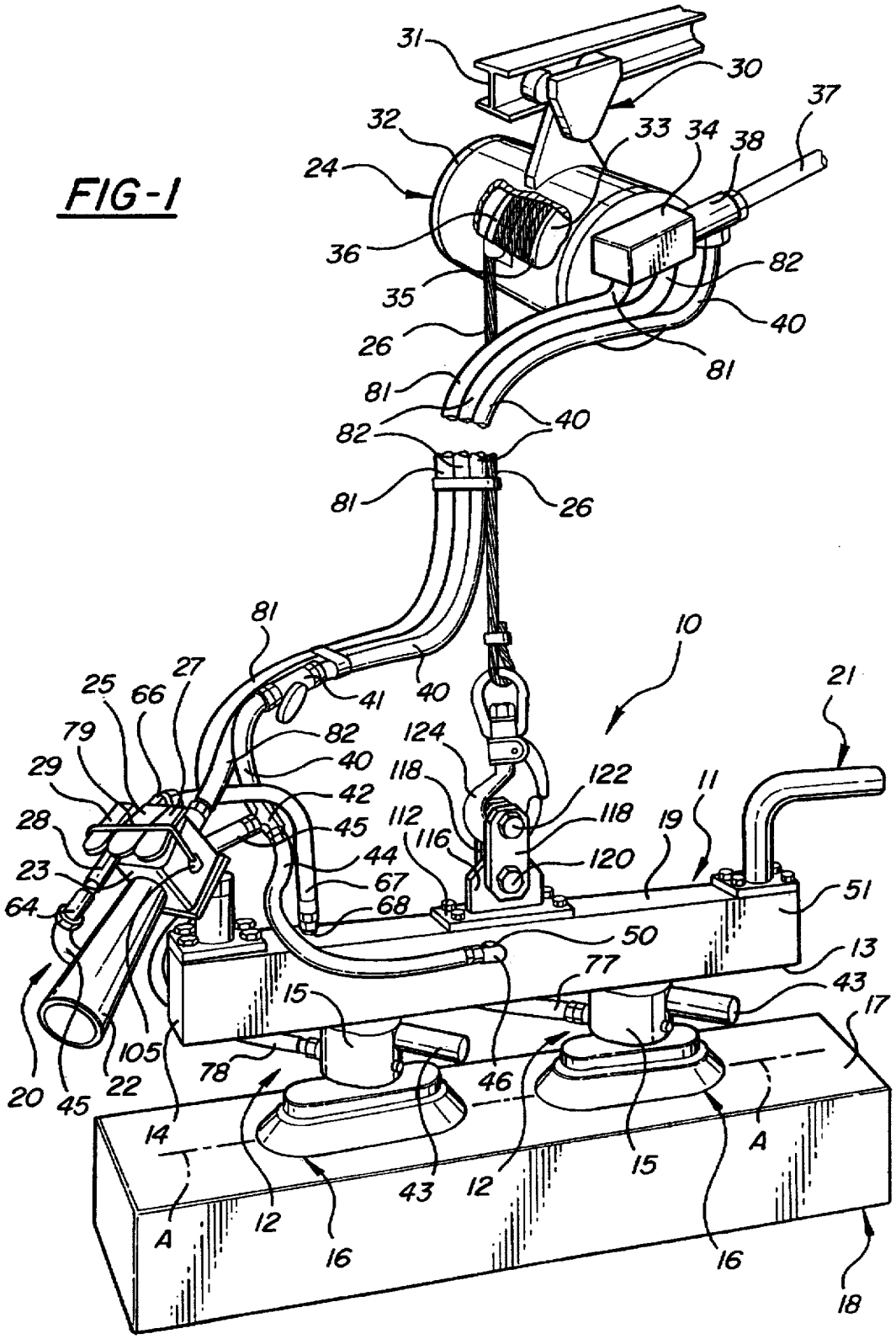
FIG. 1 is a schematic overall view in perspective, with parts broken away, of a battery lift apparatus, in conjunction with an air hoist, for loading a plurality of heavy batteries, in a vehicle battery tray.

Referring now to the drawings in detail, numeral 10 in FIG. 1 generally indicates a battery lift apparatus adapted for lifting and transporting heavy batteries for use in electric powered vehicles. The lift apparatus 10 includes a rectangular-shaped elongated carrier beam 11 of electrically insulative structural plastic material, which in the preferred embodiment is reinforced nylon. As best seen in FIGS. 4–6, the beam 11 is formed with a passageway arrangement enabling the beam to provide both a battery carrier and, in combination with a flexible air line network, a distribution manifold for the pressurized system air.

Figure 2:
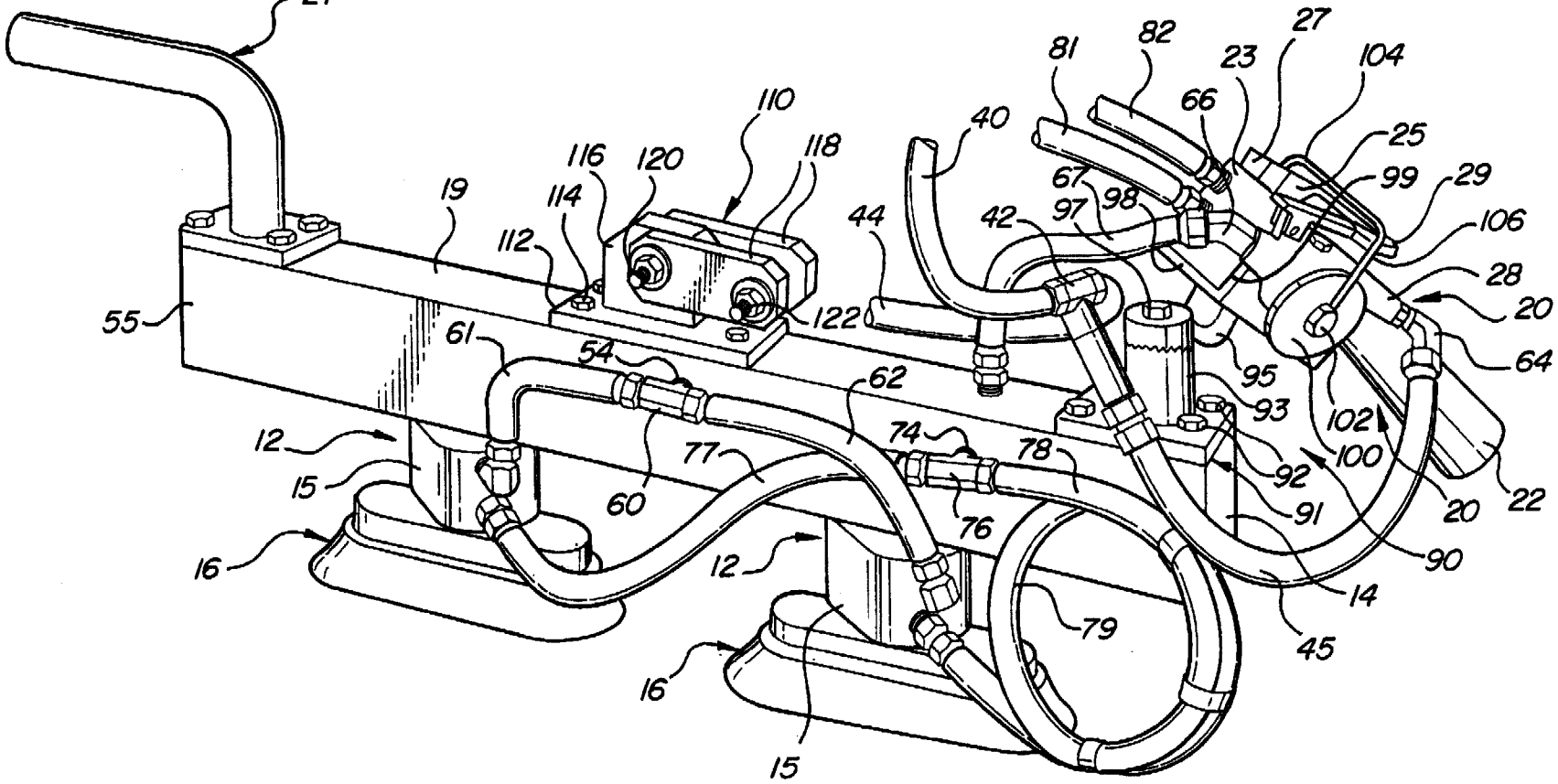
FIG. 2 is an enlarged fragmentary perspective view of the battery lift apparatus of FIG. 1, showing the opposite side of the carrier beam.

As seen in FIG. 2, the carrier beam 11 includes a pair of conventional suction assemblies 12—12, with each assembly attached, by means of a bolted mounting plate, not shown, on bottom face 13 of the beam equidistant from an associated beam end face 14—14. Each suction assembly 12 includes a vacuum generator 15—15, secured by a plurality of bolts to a beam bottom face plate, not shown, with each generator supporting a vacuum cup 16—16 of rubber material on its underside.

Each vacuum cup has an elongated oval-shape in plan, with each cup major axis, indicated at "A" in FIG. 1, in co-linear relation, whereby each cup major axis is included in the carrier beam vertically disposed longitudinal plane of symmetry, indicated by construction line "B" in FIG. 6. Each cup 16 opens downwardly with its peripheral lip adapted for sealing contact with an upper flat face 17 of an elongated electric vehicle battery, generally indicated at 18 in FIG. 1. It will be noted that, in the disclosed embodiment, the vehicle battery 18 is about 30 inches in length and has a weight of about 55 pounds.

Each suction assembly vacuum generator 15—15, which is a standard component, includes a venturi, not shown, operative upon receiving system air to create a vacuum in its vacuum cup 16 enabling the cup's lip to seal and hold the battery face 17. Each vacuum generator also includes a known valving arrangement to supply pressurized air to release its vacuum cup 16, thereby enabling the vacuum cups 16—16 to release the battery 18 upon being positioned in a vehicle battery tray, for example. The known suction assemblies 12 are commercially available under the name "Stilson Vac-Lok Vacuum Generator and Lock", manufactured by Stilson, a Division of Stocker & Yale, Inc., 34755 Commerce Road, Fraser, Mich. 48026.

With reference to FIG. 1, upper face 19 of the carrier beam 11 mounts a first handle, in the form of valve actuator handle assembly 20, mounted adjacent one end face 14 of the beam. A second beam handle, in the form of a right-angle shaped handle member 21, is mounted on upper face 19 of the beam, adjacent its opposite end face 14. The handle assembly 20 includes an upwardly inclined gripping handle 22 secured at its upper end in the housing of a two valve unit control valve block 23 for controlling a conventional overhead air hoist, indicated generally at 24. The control valve block 23 has a down lever actuator 25, adapted when depressed, for opening a down-valve unit, not shown, and lowering an air hoist cable 26. The control valve block has an up lever actuator 27, adapted when depressed, to open an up-valve unit, not shown, and raising the hoist cable.

A "blow-off", or "battery drop" pilot release valve 28 has a lever actuator 29, juxtaposed the lever actuator 25, operative when depressed, to open the pilot valve for communicating system air to each vacuum cup 16, via an associated flexible line and generator 15—15, thereby simultaneously releasing the vacuum supplied to each cup 16—16. It will be noted that with an operator's hand grasping the handle 22, each of the lever actuators 25, 27, and 29, by virtue of being positioned in juxtaposed side-by-side relation, are adapted to be readily depressed by a finger of the operator's hand grasping the handle 22.

The fluid-operated air hoist 24 is preferably of the type sold under the name "Zimmerman Balance Air Unit" and manufactured by Zimmerman International Corp., 29555 Stephenson Highway, Madison Heights, Mich. 480712387. It will be noted that other fluid-operated hoists can be used with the present invention in addition to the hoist 24.

Air hoist 24, supported by a trolley assembly 30 from guide rail 31, includes a housing 32 having a chamber 33 to which system air is supplied, by means of a valve, not shown, of a master manifold 34 on one end of the housing, acting on a movable piston 35. A cable drum 36 is located adjacent the piston 35 and carries the flexible cable 26. When the master manifold 34 supplies air under sufficient pressure to chamber 33, it forces the piston 35 toward the left and moves the cable drum 36 in the same direction. The drum 36 is supported on a ball-screw, not shown, which causes the drum to rotate as it moves longitudinally therealong in the housing 32. When the piston 35 moves toward the left, the drum 36 rotates in a manner to raise the cable 26 and its load. When the pressure in the chamber 33 is sufficiently low, the weight of the load carried on the cable will cause the drum 36 to rotate in the opposite manner to lower the cable and cause the piston 35 to move toward the right, reducing the volume of the chamber. Hence, when the pressure in the chamber 33 is sufficiently high, it will raise the cable 26 and the battery lift apparatus 10; when the pressure is sufficiently low, the battery lift apparatus and the cable move lower.

Referring to FIG. 1, system air from overhead flexible conduit 37, is split by an air hoist fitting 38, for communication with both the master manifold 34 and a flexible system air supply hose or line 40 for the battery lift apparatus 10. The pressure in the chamber 33 is adapted for control by the remote control valve block 23 supported on the carrier beam handle assembly 20, upon the lever actuators 25 and 27 being manipulated by an operator, standing on the floor below the hoist 24, gripping the handle 22.

Plant or shop air, at a pressure of about 102 psi, flows through a conventional air filter, air lubricator, air pressure regulator, and manual air dump valve with lockout, none of which are shown. The pressure regulator reduces the shop air supply to a predetermined constant system air pressure which, in the disclosed embodiment, is about 80 psi. System air from the air hoist fitting 38 is supplied to the supply line 40, tied to the hoist cable 26, through a manual shut-off valve 41. During operation of the lift apparatus 10, the shut-off valve 41 has its manual lever rotated to its open position allowing system air to be communicated from the outlet of valve 41 to a first T-fitting 42. The shut-off valve 41 allows an operator to cut-off system air to the lift apparatus 10 when it is not being used, thereby obviating the noise of escaping air from exhaust ports connected to associated vacuum generator mufflers 43—43.

With reference to FIG. 1, it will be seen that the T-connection 42 directs system air to flexible beam first supply line 44 and release valve supply line 45. The first supply line 44 communicates with an angle fitting 46 secured to a side inlet 50 in one side face 51 of the carrier beam 11. As seen in FIG. 4, a transverse passage 52 in the beam 11 communicates system air from inlet 50 to an outlet 54, provided in opposite side face 55 of the beam. The beam passageway 52 is one of a plurality of beam manifold passageways which, in combination with a plurality of flexible hose supply lines, provide a system air distribution network. FIG. 2 shows the beam outlet 54 connected to a second T-fitting 60, wherein first 61 and second 62 flexible venturi lines each provide system air to a respective vacuum creating venturi, not shown, provided in each of their associated vacuum generators 12—12.

In FIG. 2, line 45 of the first T-fitting 42 communicates with handle inlet fitting 64 of the pilot release valve 28. An outlet fitting 66 of the release valve 23 is connected by a second beam inlet line 67 to a second beam inlet 68 in the beam upper face 19. Referring to FIGS. 4–6, a vertical passage portion 70 in the carrier beam provides communication between the beam second inlet 68 with beam horizontal passage portion 72, having a second beam outlet 74 in the beam opposite side face 55. FIG. 2 shows a third T-fitting 76 receiving system air from the beams second system air outlet 74 for supply to a pair of oppositely extending vacuum release lines 77 and 78, with each line 77 and 78 having its output connected to a vacuum release inlet port of its associated vacuum generator 15. It will be noted that vacuum release line 78 has been tuned by means of an extra line loop 79, which loop functions to supply balanced release system air to the generator vacuum cups 16—16, achieving simultaneous vacuum release of the cups. It will be noted that the venturi air system supply lines 61 and 62 are also tuned to create the required vacuum balance in each of the cups 22.

Referring to FIG. 1, each down-valve and up-valve unit of the control valve block 23 is in communication with a respective valve unit, not shown, in the master manifold 34 through an associated flexible down 81 and up 82 control lines 81 and 82, secured to the hoist cable 26. When the down-valve unit lever actuator 25 is depressed, control system air flows through the down line 81 to the master manifold 34, past an associated valve means, and into the chamber 33. The pressure in the chamber can then be increased as long as the down lever 25 is depressed, with the pressure increasing up to the system air pressure in the control line 81. Also, pressure in the hoist chamber 33 can be decreased by depression of the up-valve unit lever actuator 27, whereby the chamber 33 can then be vented to the atmosphere through a vent passage in the master manifold 34.

Referring to FIG. 3, the handle assembly 20 is shown mounted on the beam upper face 19 by an adjustable mounting bracket assembly 90, which includes a bracket base 91 secured on beam upper face 19 by bolts 92. A cylindrical stem 93 extends vertically upwardly from the base 91 and terminates at its upper end in a ribbed stem seat 94, formed with a plurality of radially extending raised indexing ribs. The bracket assembly 90 further includes a bracket arm 95 having an indexing disc 96 fixed on one end, formed with a plurality of radially extending indexing ribs on its underside in matching relation to the ribbed stem seat 94. A disc central bolt hole is axially aligned with a stem axial threaded bore, through which a hex-head adjusting bolt 97 extends for threaded reception in the stem axial bore. The bracket arm 95 upper end is fixed to a leg plate 98 of an arm support angle, which leg plate 98 is bolted to an underside of the control valve block 23.

The pilot release valve 28 is supported on an outward surface of arm angle upstanding flange 99 by a washer 100, retained by bolt 102 threaded in a bore of the flange 99. A U-shaped wire guard 104 for the three lever actuators 25, 27, and 29, has one leg 105 welded to the valve block 23 and its other leg 106 welded to the washer 100.

Referring to FIG. 2, a cable connection arrangement 110 includes a metal anchor plate 112 secured by bolts 114 to beam upper face 19. Anchor plate 112 supports an upstanding metal tongue 116 positioned in the vertically disposed longitudinal plane of symmetry of the beam, which plane includes construction line "B" in FIG. 6. The anchor plate is sandwiched between a pair of strap members 118—118 of electrically insulative fibre material. In the disclosed embodiment, the fibre material is commercially available under the name "Micarta". FIG. 1 shows the straps 118 rotated to a vertical position, supporting the battery lift apparatus 10 and battery 18, wherein each strap member 118 has a lower end pivoted to a bolt 120 which extends through a tongue circular aperture, not shown. Each strap member free end is joined by a coupling bolt 122 shown engaged by a swivel hook assembly 124 secured to the hoist cable lower end.

The battery lift device 10 employs two operators to load a vehicle battery tray. In operation, a first operator grasps the actuator handle 22 with one hand and a second operator grasps the handle member 21 with a hand opposite from the handle gripping hand of the first operator. Upon a battery 18 being lifted from a storage rack, the operators orient the carrier beam 11 transverse to the longitudinal axis of the tray. The two operators walk on respective sides of the tray, advancing the lift apparatus along the tray's longitudinal axis. Upon positioning the battery vertically above a predetermined tray area, the first operator depresses the down lever actuator 25, lowering the transported battery onto the area. The first operator next depresses the vacuum release lever actuator 29 causing supply air to enter the vacuum cups releasing the apparatus 10 from the battery, whereupon the operators mechanically secure both ends of the released battery to corresponding ends of its adjacent battery, and electrically wire the released battery in series with the adjacent battery. The first operator then depresses the up lever actuator 27, raising the apparatus for return to the battery supply rack to load the next battery.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A vehicle battery lift apparatus for use with an overhead air hoist comprising:

a plurality of suction assemblies mounted on a bottom surface of a rectangular-shaped carrier beam of electrically insulative structural plastic material, said beam being formed with a plurality of manifold passageways which, together with a plurality of flexible connecting lines, provide a system air distribution network supplying system air from the air hoist to said apparatus;

said network supplying system air to a vacuum generator of each suction assembly for evacuating air from a vacuum cup supported on each generator, thereby enabling said vacuum cups to lift and hold a heavy battery, and said network adapted for supplying system air to each said vacuum cup to release the battery;

said beam having an electrically insulative cable connection arrangement, adjacent its midpoint, adapted for attachment to a vertically extending flexible cable of the air hoist; and first and second handles supported on said beam adjacent each end face thereof, said first handle supporting a pair of system air valve actuators for controlling down and up movement of the air hoist cable, and a release valve actuator operable to communicate vacuum releasing system air to each vacuum cup, whereby each said actuator is adapted for manipulation by a finger of an operator's hand gripping said first handle.

2. The battery lift apparatus as set forth in claim 1 wherein said beam mounts a pair of suction assemblies, and each said suction assembly vacuum generator is fixed to said beam bottom face substantially equidistant from an associated beam end face.

3. The battery lift apparatus as set forth in claim 1 wherein said valve actuators are in the form of lever actuators closely arranged in a side-by-side manner.

4. The battery lift apparatus as set forth in claim 1 wherein said first actuator handle is mounted on said beam by a handle bracket assembly comprising a base, fixed to said beam, and a handle support arm, said base having an upstanding stem terminating in a mounting seat, said arm having a disc on one end rotationally secured, by a releasable threaded fastener, on said stem seat, and indexing means on said stem seat and on an opposed face of said disc adapted for selective interlocking engagement, whereby loosening said threaded fastener allows ergonomic rotational adjustment of said actuator handle.

5. The battery lift apparatus as set forth in claim 1 wherein each said vacuum cup has an elongated oval-shaped periphery, each cup having its major axis aligned on a common axis, whereby said common axis is included in a vertically disposed longitudinally extending plane of symmetry of said carrier beam.

6. The battery lift apparatus as set forth in claim 1 wherein said beam cable connection arrangement comprises an anchor plate, fixed to an upper face of said beam, supporting an upstanding tongue of metallic material positioned in a vertically disposed longitudinally extending plane of symmetry of said beam, said tongue being sandwiched between a pair of upstanding strap members of electrically insulative fibre material, each said strap member having a lower end pivoted to a first bolt extending through a tongue circular aperture having its center adjacent the beam longitudinal midpoint, and each said strap having an upper end receiving a second bolt therethrough adapted for engagement by hook means attached to a free end of the hoist cable.

7. The battery apparatus as set forth in claim 1 wherein said carrier beam is formed of reinforced nylon material.

* * * * *